US007296354B2

(12) United States Patent
Van Deursen et al.

(10) Patent No.: US 7,296,354 B2
(45) **Date of Patent: *Nov. 20, 2007**

(54) COMBINATION UTILITY AND SPORTING KNIFE

(75) Inventors: Gary E. Van Deursen, Avon, CT (US); Stephen Rowlay, Sheffield (GB); Craig Roberts, Sheffield (GB)

(73) Assignee: The Stanley Works, New Britain, CT (US)

( * ) Notice: Subject to any disclaimer, the term of this patent is extended or adjusted under 35 U.S.C. 154(b) by 10 days.

This patent is subject to a terminal disclaimer.

(21) Appl. No.: 11/356,145

(22) Filed: Feb. 17, 2006

(65) Prior Publication Data

US 2006/0137190 A1 Jun. 29, 2006

Related U.S. Application Data

(63) Continuation of application No. 11/168,451, filed on Jun. 29, 2005, which is a continuation of application No. 09/984,865, filed on Oct. 31, 2001, now Pat. No. 6,957,491.

(51) Int. Cl.
*B26B 1/00* (2006.01)
*B25F 1/04* (2006.01)

(52) U.S. Cl. ..... 30/142; 30/152; 30/160; 30/162; 7/118

(58) Field of Classification Search ..... 30/142, 30/123, 143, 161, 150–159, 160, 162, 125, 30/33.5, 330, 320, 128, 336; 7/118, 128; D22/118; D8/99, 105, 95, 107, 98, 100, D8/118

See application file for complete search history.

(56) References Cited

U.S. PATENT DOCUMENTS 166,099 A 7/1875 Hastings et al.
521,555 A 6/1894 Scheerer ..... 30/161
988,068 A 3/1911 Beardsley et al. ..... 30/161
1,194,486 A 8/1916 Downs ..... 86/22
1,388,014 A 8/1921 Aiguier
1,828,121 A 10/1931 Adam et al.
2,575,652 A 11/1951 Bovee
2,906,021 A * 9/1959 Cromoga ..... 30/293
2,980,996 A 4/1961 Beran
3,061,927 A 11/1962 Von Frankenberg und Ludwigsdorf (Continued)

FOREIGN PATENT DOCUMENTS

CH 284158 11/1952

*Primary Examiner*—Boyer D. Ashley
*Assistant Examiner*—Ghassem Alie
(74) *Attorney, Agent, or Firm*—Pillsbury Winthrop Shaw Pittman LLP

(57) ABSTRACT

A combination utility and sporting knife includes a longitudinal knife handle, a utility blade carrier disposed within the handle and linearly movable within the handle, a utility blade carried by the blade carrier, a manual movable blade moving member operatively connected with the blade carrier, and a pivotally movable blade pivotally connected to the handle. The utility blade and the pivotally movable blade are extendable from opposite ends of the handle. The utility blade edge and the pivotally movable blade edge both are exposed towards the bottom portion of the handle when the pivotally movable blade and the utility blade are in operative positions thereof so that the bottom and top portions of the handle retain their relative bottom and top orientations for use of either the utility blade or the pivotally moveable blade.

12 Claims, 11 Drawing Sheets

U.S. PATENT DOCUMENTS 3,596,300 A 8/1971 D'Amico ..... 7/106
3,660,896 A 5/1972 Umholtz
D236,579 S 9/1975 Morhack
4,078,272 A 3/1978 Mahon, III ..... 24/186
4,265,017 A 5/1981 Collins
4,302,877 A 12/1981 Hart et al. ..... 30/161
4,461,081 A 7/1984 Gaskins
4,491,261 A 1/1985 Mitsuhashi
4,517,741 A 5/1985 Castelluzzo
4,604,805 A 8/1986 Krieger ..... 30/330
4,635,309 A 1/1987 Larsen
4,660,284 A 4/1987 Decarolis
4,748,743 A 6/1988 Anderson et al.
4,776,094 A 10/1988 Glesser ..... 30/160
4,783,867 A 11/1988 Tsao
4,813,132 A 3/1989 Castelluzzo
4,817,284 A 4/1989 Sacherman et al.
4,823,463 A 4/1989 Lemaire
4,835,865 A * 6/1989 Knoop ..... 30/162
4,890,387 A 1/1990 Canino
4,939,839 A 7/1990 Gorst ..... 30/125
5,023,996 A 6/1991 Pape et al.
D324,899 S 3/1992 Thompson ..... D22/118
5,093,994 A 3/1992 Karas ..... 30/125
5,230,152 A 7/1993 Kennedy
5,283,954 A 2/1994 Szabo ..... 30/125
5,293,690 A 3/1994 Cassady ..... 30/161
5,301,428 A 4/1994 Wilcox
5,337,481 A * 8/1994 Mears ..... 30/162
5,511,262 A 4/1996 Horng
5,511,311 A 4/1996 Collins ..... 30/162
5,513,405 A 5/1996 Bradbury, Jr. et al.
5,528,834 A 6/1996 Seber et al.
D371,288 S 7/1996 Thompson
5,572,793 A 11/1996 Collins et al. ..... 30/157
D378,982 S 4/1997 Thompson
5,661,908 A 9/1997 Chen ..... 30/125
D384,871 S 10/1997 McWillis ..... D8/99
D386,381 S 11/1997 Black et al.
5,689,890 A 11/1997 Glesser
5,778,536 A 7/1998 West ..... 30/123
5,806,189 A 9/1998 Bailey ..... 30/125
5,906,049 A 5/1999 Butts ..... 30/125
5,940,970 A 8/1999 D'Ambro, Sr. et al.
D414,989 S 10/1999 Shamoon
5,960,544 A 10/1999 Beyers
5,987,751 A 11/1999 Chung
6,026,575 A 2/2000 Wonderley ..... 30/125
6,088,861 A 7/2000 Sessions et al. ..... 7/128
6,125,543 A 10/2000 Jhones ..... 30/161
6,148,522 A 11/2000 Dobandi ..... 30/162
6,161,290 A 12/2000 Takamasa
D436,014 S 1/2001 Glesser ..... D8/99
6,170,104 B1 1/2001 Seber et al.
D437,767 S 2/2001 Van Deursen ..... D8/99
6,192,589 B1 2/2001 Martone et al.
D438,443 S 3/2001 Keating ..... D8/99
6,233,769 B1 5/2001 Seber et al.
D446,689 S 8/2001 Van Leeuwen
6,354,007 B1 3/2002 Scarla
6,397,476 B1 6/2002 Onion ..... 30/160
6,467,173 B1 * 10/2002 Umstead et al. ..... 30/144
6,481,034 B2 11/2002 Elsener et al. ..... 7/118
D473,778 S 4/2003 Hsu ..... D8/99
6,701,626 B2 3/2004 Knoop ..... 30/337
6,715,209 B2 * 4/2004 Taylor et al. ..... 30/155
6,742,261 B2 * 6/2004 Ho ..... 30/162
7,003,833 B2 * 2/2006 Feliciano ..... 7/148
7,124,510 B2 * 10/2006 Frazer ..... 30/161
2002/0157260 A1 10/2002 Cheng ..... 30/161
2007/0056170 A1 * 3/2007 Rowlay ..... 30/162

* cited by examiner

COMBINATION UTILITY AND SPORTING KNIFE

CROSS-REFERENCE

This application is a continuation of U.S. application Ser. No. 11/168,451, titled "COMBINATION UTILITY AND SPORTING KNIFE," filed Jun. 29, 2005, which is a continuation of U.S. application Ser. No. 09/984,865, titled "COMBINATION UTILITY AND SPORTING KNIFE," filed Oct. 31, 2001 and issued Oct. 25, 2005 as U.S. Pat. No. 6,957,491, the contents of both of which are incorporated herein in their entirety.

FIELD OF THE INVENTION

The present invention relates generally to cutting devices.

BACKGROUND OF THE INVENTION

Cutting devices, such as utility blades and knives, are typically manufactured, and used separately. However, this may become inconvenient to those who frequently use these devices.

It has been proposed in U.S. Pat. No. 4,890,387 to provide a drywall utility knife that includes a utility blade at one end of the knife and a serrated drywall saw at the opposite end of the knife. As a result, the same utility knife may be conveniently used to both cut and saw drywall.

However, this patent discloses an arrangement in which the cutting edge of the utility blade is exposed towards a bottom portion of the knife and the cutting edge of the saw is exposed towards an upper portion of the knife. The arrangement lacks a uniform handle orientation when using either the utility blade or the saw. In addition, the saw is intended for a relatively specific purpose and lacks versatility. There is a need for an ergonomic utility knife that can also be used for multi-purpose cutting operations.

SUMMARY OF THE INVENTION

It is thus an object of the present invention to address the need noted above. In accordance with the principles of the present invention, this objective is achieved by providing a combination utility and sporting knife. The combination includes a longitudinal knife handle, a utility blade carrier, a utility blade, a manual movable blade moving member, and a pivotally movable blade. The utility blade carrier is disposed within the handle and linearly movable within the handle. The utility blade is carried by the blade carrier. The utility blade has a trapezoidal shape, a longest side of which comprises a linear cutting edge. The manual movable blade moving member is operatively connected with the blade carrier and is disposed towards an upper portion of the handle. The blade moving member is linearly movable between 1) a first position wherein the utility blade carrier and the blade carried thereby are positioned so that the utility blade is in a storage position wherein the cutting edge thereof is confined within the handle, and 2) an second position wherein the utility blade carrier and the blade carried thereby are positioned so that the utility blade is in an operative position wherein the cutting edge thereof extends outwardly from the handle. The pivotally movable blade is pivotally connected to the handle. The pivotally movable blade includes a cutting edge and an opposite dull edge. The cutting edge has a convex forward portion, the convex forward portion of the cutting edge intersecting with the dull edge to form a forward point of the pivotally movable blade. The pivotally movable blade is movable between a storage position wherein the cutting edge thereof is concealed by the handle and an operative position wherein the cutting edge is exposed. The utility blade and the pivotally movable blade are extendable from opposite ends of the handle. The utility blade edge and the pivotally movable blade edge both are exposed towards the bottom portion of the handle when the pivotally movable blade and the utility blade are in the operative positions thereof so that the bottom and top portions of the handle retain their relative bottom and top orientations for use of either the utility blade or the pivotally moveable blade.

These and other objects, features, and advantages of this invention will become apparent from the following detailed description when taken into conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF PREFERRED EMBODIMENTS

Figure 1:
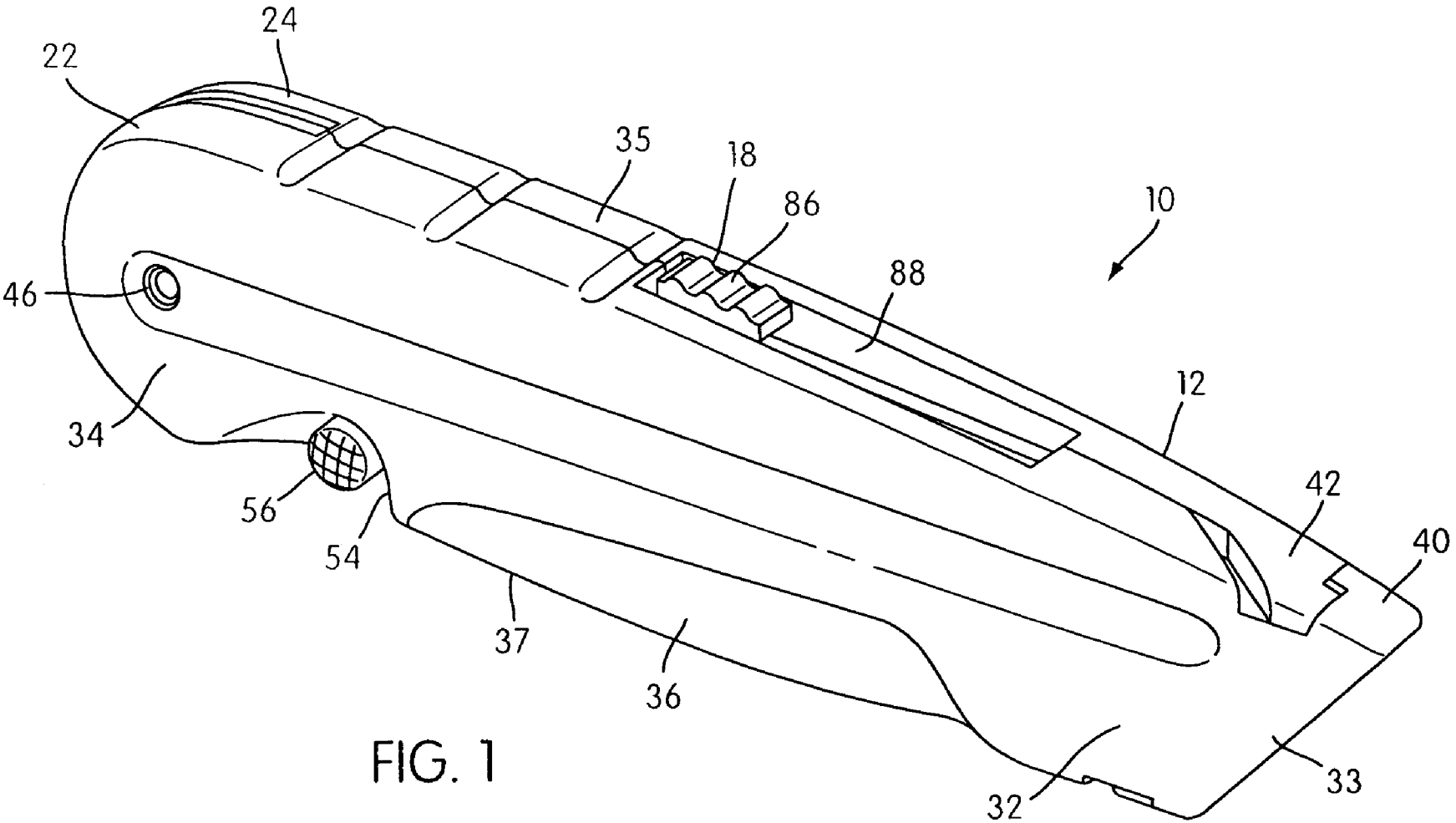
FIG. 1 is a perspective view of an embodiment of the combination utility and sporting knife constructed according to the principles of the present invention.

Referring now more particularly to the drawings, there is shown therein a combination utility and sporting knife 10 in accordance with one illustrated embodiment of the present invention. The main components of the combination 10 are a longitudinal knife handle 12, a utility blade carrier 14, a utility blade 16 carried by the blade carrier 14, a manual movable blade moving member 18 operatively connected with the blade carrier 14, and a pivotally movable blade 20. The utility blade carrier 14, the utility blade 16, and the manual movable blade moving member 18 may be referred to as a utility blade assembly 21.

As shown in FIGS. 1-4, the handle 12 is substantially hollow and includes first and second mating handle halves 22, 24 with the blade carrier 14 and the movable blade 20 movably mounted between the handle halves 22, 24. A movable blade locking mechanism 26, a blade interlocking mechanism 28, and a utility blade replacement mechanism 30 is also mounted between the handle halves 22, 24, as will be further discussed.

The first and second handle halves 22, 24 have complementary configurations and cooperate to provide a handle 12 having a forward utility blade retaining portion 32, a rearward movable blade retaining portion 34, and an intermediate gripping portion 36. The exterior surface of the handle 12 is suitably contoured to assist the user in holding onto the gripping portion 36 of the handle 12 and to facilitate employment of both the utility blade 16 and the movable blade 20 to perform various cutting tasks. Specifically, the top portion 35 of the handle 12 is contoured or arranged, preferably slightly convex, to more comfortably accommodate the palm of the user's hand. Likewise, the bottom portion 37 of the handle 12 is contoured or arranged to more comfortably accommodate the fingers of the user rather than the palm. As a result, the bottom and top portions 35, 37 of the handle 12 retain their relative bottom and top orientations for use of either the utility blade 16 or the moveable blade 20 during cutting tasks.

The gripping portion 36 may include an elastomeric material thereon to further facilitate gripping.

The utility blade retaining portions 32 of the first and second handle halves 22, 24 cooperate to form a nose portion 33 from which the utility blade 16 projects outwardly and forwardly to present a cutting edge 38 thereof. Further, the utility blade retaining portion 32 of the first handle half 22 provides a first cooperating interlocking structure 40 and the utility blade retaining portion 32 of the second handle half 24 provides a second cooperating interlocking structure 42. The first and second cooperating interlocking structures 40, 42 are configured to interlock with one another to prevent relative pivotal movement between the first and second handle halves 22, 24 with respect to one another.

The movable blade retaining portion 34 of the first handle half 22 includes a threaded boss 44 that extends upwardly from an interior surface thereof. A fastener 46 extends through the movable blade retaining portion 34 of the second handle half 24, through a journal structure 48 that pivotally mounts the movable blade 20, and into the threaded boss 44 to fixedly secure the first and second handle halves 22, 24 to one another in the cooperating interlocking relation.

The first handle half 22 also includes a hollow boss 50 on the interior surface that receives a protrusion 52 provided on the interior surface of the second handle half 24 to prevent relative pivotal movement between the first and second handle halves 22, 24 with respect to one another.

Further, the handle 12 includes a cutout 54 in order to receive a thumb button 56 provided on the movable blade 20.

It is contemplated that the first and second handle halves 22, 24 are pivotally mounted to one another such that the first and second handle halves 22, 24 are pivotally movable relative to one another in a swivel fashion between open and closed positions.

Figure 4:
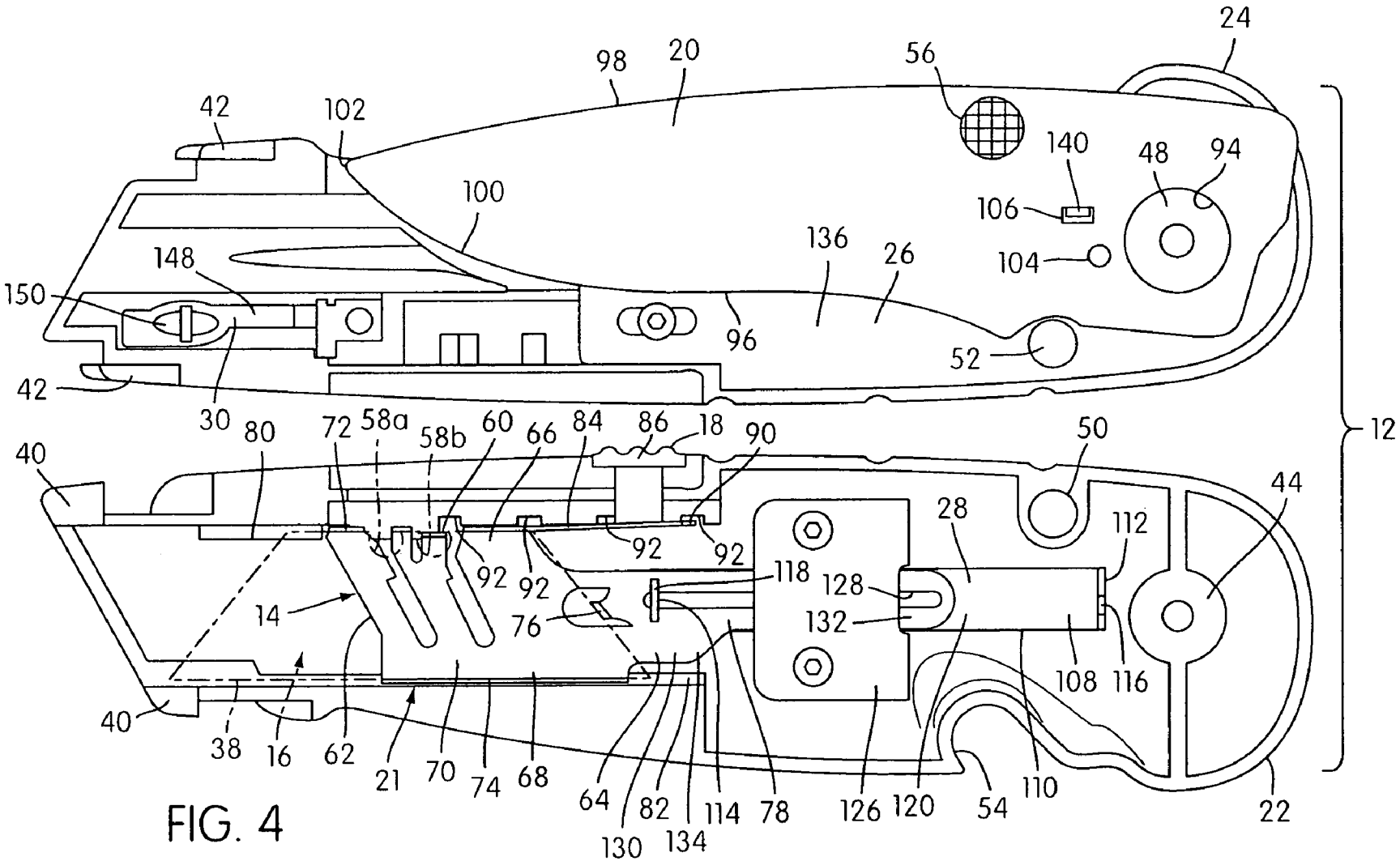
FIG. 4 is a top view of the first and second handle halves and the interior components thereof.

Referring now more particularly to FIG. 4, the utility blade carrier 14 is disposed within the handle 12 and linearly movable within the handle 12. The utility blade 16 is carried by the blade carrier 14. Specifically, the utility blade 16 is mounted in the blade carrier 14 to project outwardly from the nose portion 33 of the handle 12 to present the linear cutting edge 38.

The utility blade 16 has a trapezoidal shape, a longest side of which includes the linear cutting edge 38. The shorter side of the utility blade 16 includes at least one locating notch 58*a*, 58*b*configured to mate with a complementary blade engaging protrusion 60 provided on the blade carrier 14. In the illustrated embodiment, the utility blade 16 has first and second notches 58*a*, 58*b* with the second notch 58*b* mating with the protrusion 60.

Specifically, the blade carrier 14 is in the form of an interval sheet metal slide that includes forward and rearward ends 62, 64 and upper and lower ends 66, 68. A web portion 70 extends between the upper and lower ends 66, 68. The web portion 70 has a planar face for abutting against the planar side face of the utility blade 16 to provide lateral retention and support for the utility blade 16. Upper and lower blade retaining flanges 72, 74 are positioned at the upper and lower ends 66, 68 of the blade carrier 14, respectively. The upper and lower flanges 72, 24 extend outwardly from the web portion 70 to provide vertical retention and support for the utility blade 16. The blade engaging protrusion 60 is positioned slightly below the upper flanges 72 and extends outwardly from the web portion 70. As illustrated in FIG. 4, the blade engaging protrusion 60 is received within the second notch 58*b* of the utility blade 16 to retain the utility blade 16 in a fixed longitudinal position relative to the blade carrier 14. The blade carrier 14 includes a stop member 76 on the web portion 70 configured to abut the angular edge of the utility blade 16 to facilitate placement of the utility blade 16 in the blade carrier 14. The blade carrier 14 also includes a rearwardly extending actuating slide 78 that interacts with the blade interlocking mechanism 28, as will be further discussed.

The blade carrier 14 is slidably positioned on upper and lower guide structures 80, 82 provided in the first handle half 22.

Figure 10:
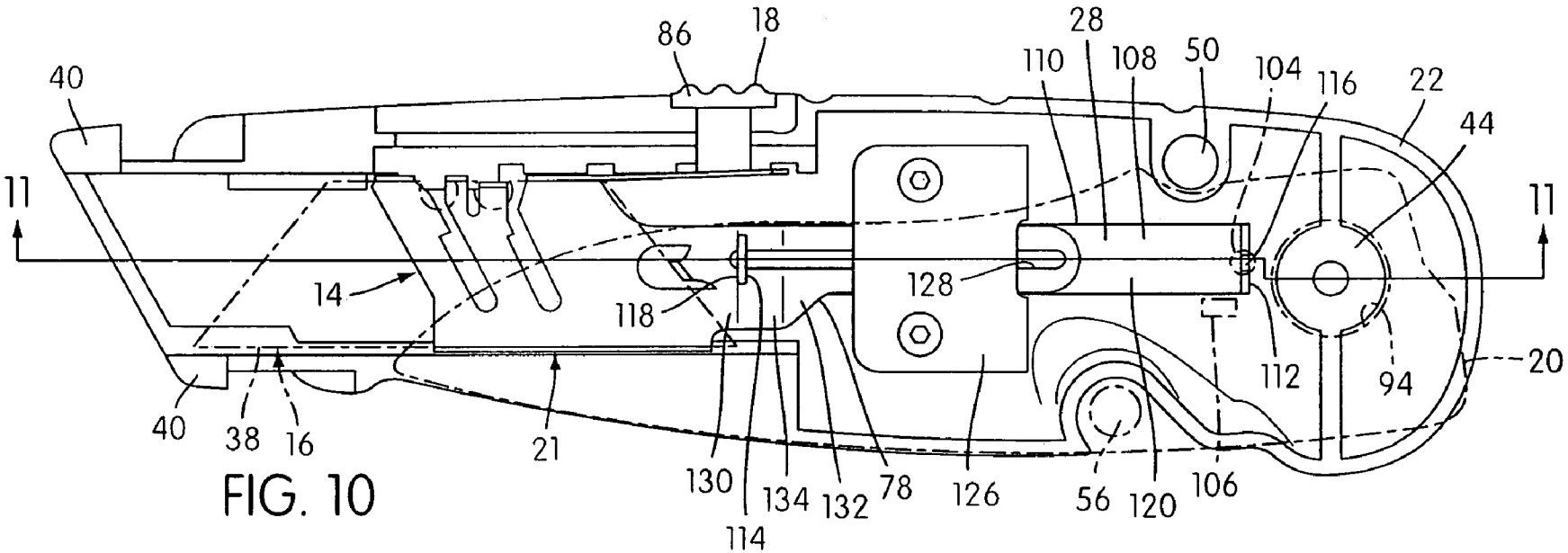
FIG. 10 is a top view of the first handle half illustrating the pivotally movable blade and the utility blade in the storage position, the utility blade and the pivotally movable blade shown in phantom in order to illustrate the blade interlocking mechanism.
Figure 12:
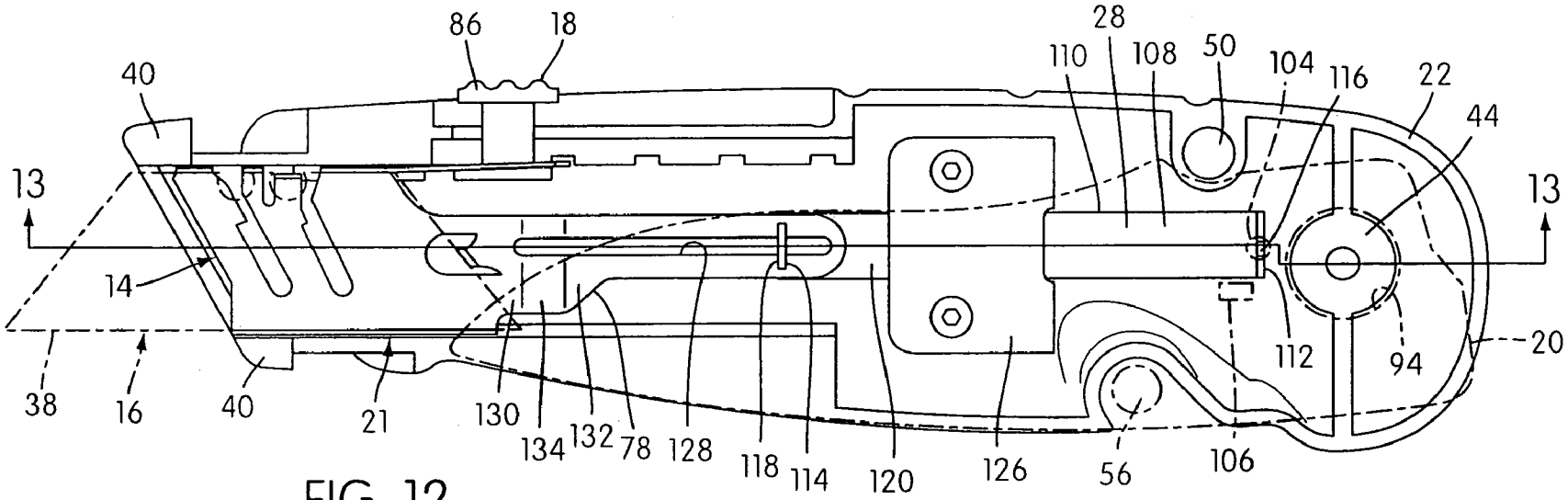
FIG. 12 is a top view of the first handle half illustrating the pivotally movable blade in the storage position and the utility blade in the operative position, the utility blade and the pivotally movable blade shown in phantom in order to illustrate the blade interlocking mechanism.

The manual movable blade moving member 18 is operatively connected with the blade carrier 14 and disposed towards an upper portion of the handle 12. The blade moving member 18 is linearly movable between a first position (as shown in FIGS. 4 and 10) and a second position (as shown in FIG. 12). In the first position, the utility blade carrier 14 and the utility blade 16 carried thereby are positioned so that the utility blade 16 is in a storage position wherein the cutting edge 38 thereof is confined within the handle 12. In the second position, the utility blade carrier 14 and the utility blade 16 carried thereby are positioned so that the utility blade 16 is in an operative position wherein the cutting edge 38 thereof extends outwardly from the handle 12.

In the illustrated embodiment, the blade moving member 18 includes a resilient button arm 84 integrally formed at the rearward upper end of the blade carrier 14 so as to extend rearwardly and slightly upwardly therefrom. The button arm 84 has a thumb button 86 mounted thereto that extends upwardly therefrom and through a longitudinal slot 88 provided at the top of the handle 12. The button arm 84 further includes an outwardly projecting latching tab 90 positioned at the rearward end thereof. The latching tab 90 is biased upwardly by the resilience of the button arm 84 so as to be received into any one of four notches 92 provided in the top interior of the first handle half 22 in a conventional manner. The notches 92 in the top interior of the first handle half 22 are longitudinally spaced to define multiple extended second positions (or multiple operative positions of the utility blade 16) and a single confined first position (or storage position of the utility blade 16). The first operative position of the utility blade 16 generally exposes the pointed tip of the utility blade 16 for purposes of scoring. The remaining operative positions of the utility blade 16 are generally cutting positions. The blade carrier 14 may be manually shifted in a longitudinal direction by pressing the thumb button 86 to unlatch the latching tab 90 from one of the respective notches 92 and thereafter longitudinally moving the utility blade 16 with respect to the handle halves 22, 24. The thumb button 86 may have a series of grooves formed therein for improving gripping.

The pivotally movable blade 20, also referred to as a sporting knife, is pivotally connected to the handle 12. Specifically, the movable blade 20 includes an opening 94 that receives the journal structure 48 therethrough. The journal structure 48 includes a threaded opening that receives the fastener 46 therethrough when the handle halves 22, 24 are fixedly secured to one another. As a result, the movable blade 20 is pivotable relative to the handle 12 about the journal structure 48. Washers are provided on opposing sides of the movable blade 20.

The pivotally movable blade 20 includes a cutting edge 96 and an opposite dull edge 98. The cutting edge 96 has a convex forward portion 100. The convex forward portion 100 of the cutting edge 96 intersects with the dull edge 98 to form a forward point 102 of the pivotally movable blade 20. The movable blade 20 may include a plurality of serrations on the cutting edge 96.

Figure 5:
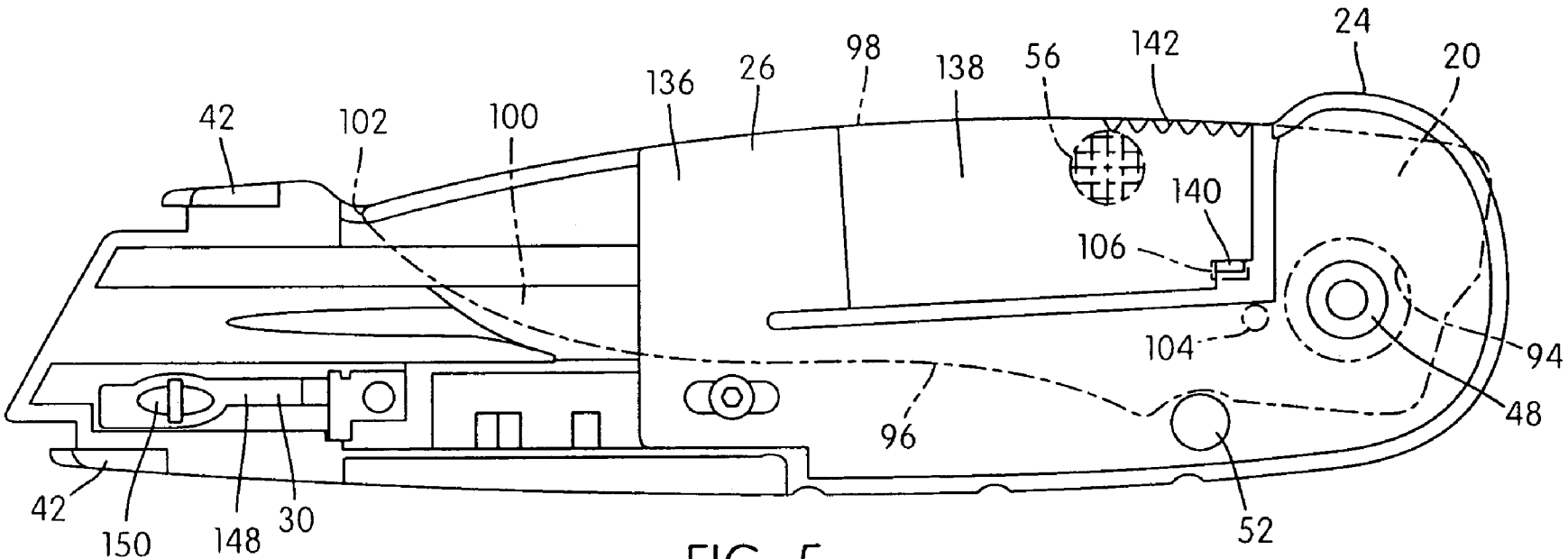
FIG. 5 is a top view of the second handle half with the pivotally movable blade shown in phantom in order to illustrate the movable blade locking mechanism.
Figure 6:
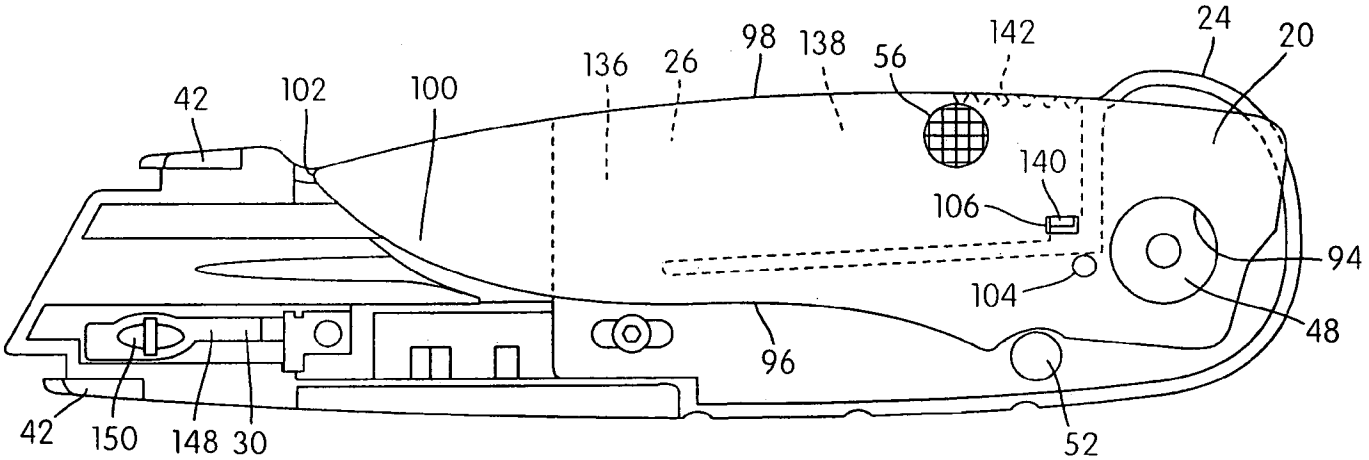
FIG. 6 is a top view of the second handle half illustrating the pivotally movable blade locked in the storage position.
Figure 7:
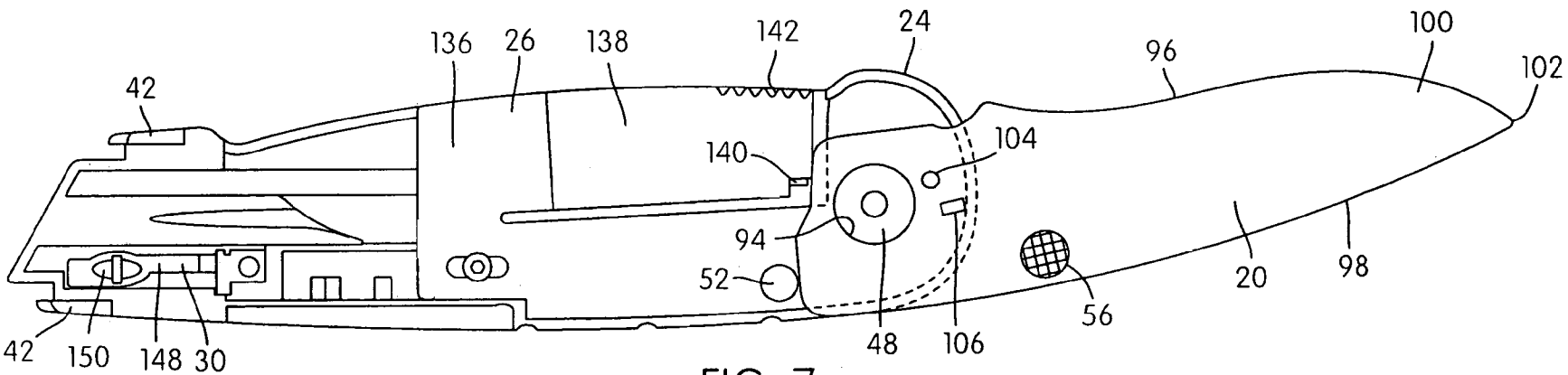
FIG. 7 is a top view of the second handle half illustrating the pivotally movable blade locked in the operative position.
Figure 14:
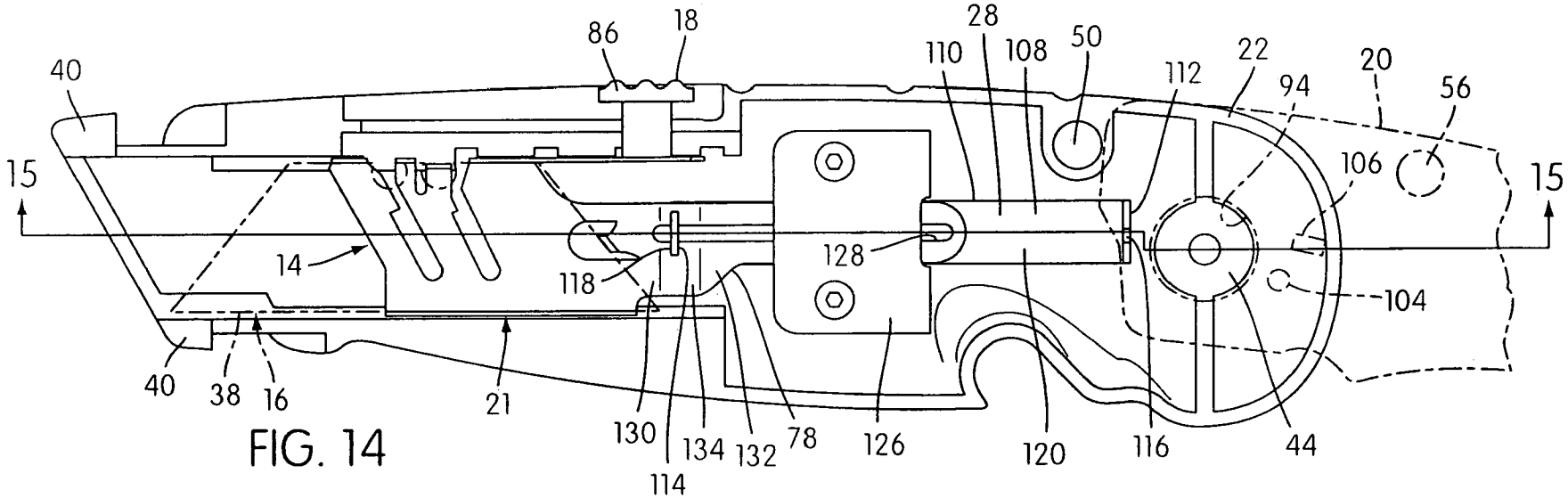
FIG. 14 is a top view of the first handle half illustrating the pivotally movable blade in the operative position and the utility blade in the storage position, the utility blade and the pivotally movable blade shown in phantom in order to illustrate the blade interlocking mechanism.

The pivotally movable blade 20 is movable between a storage position (as shown in FIGS. 4, 5, and 6) and an operative position (as shown in FIGS. 7 and 14). In the storage position, the cutting edge 96 of the movable blade 20 is concealed by the handle 12. In the operative position, the cutting edge 96 is exposed.

The movable blade 20 further includes a hole 104 that interacts with the blade interlocking mechanism 28 and a slot 106 that cooperates with the blade locking miechanism 26, as will be further discussed.

The utility blade 16 and the movable blade 20 are extendable from opposite ends of the handle 12. As shown in FIGS. 12 and 14, the utility blade cutting edge 38 and the pivotally movable blade cutting edge 96 are both exposed towards the bottom portion of the handle 12 when the movable blade 20 and the utility blade 16 are in the operative positions thereof so that the bottom and top portions 35, 37 of the handle 12 retain their relative bottom and top orientations for use of either the utility blade 16 or the moveable blade 20.

The blade interlocking mechanism 28 is provided so that only one of the utility blade 16 and the movable blade 20 may be moved to the operative position at a time. In other words, the blade interlocking mechanism 28 prevents movement of one of the utility blade 16 and the pivotally movable blade 20 from the storage position thereof when the other of the utility blade 16 and the pivotally movable blade 20 is in the operative position thereof.

Referring now more particularly to FIGS. 10-15, the blade interlocking mechanism 28 includes an elongated pivoting structure 108. The elongated pivoting structure 108 is a piece of sheet metal that is folded or otherwise deformed in a conventional manner to provide a central wall 110 and opposing end walls 112, 114 that are perpendicular to the central wall 110. One end wall 112 includes an elongated extension 116 and the opposite end wall 114 includes a T-shaped extension 118. A substantially rigid stiffening member 120 is secured to the central wall 110 between the end walls 112, 114. However, the pivoting structure 108 may be constructed as a single unitary body. Further, a pair of pivoting arms 122 extend outwardly from opposing sides of the central wall 110. As illustrated, each of the pivoting arms 122 has a rounded protuberance 124 thereon.

The first handle half 22 includes a pair of spaced apart retaining flanges on an interior surface thereof. As illustrated, the pivoting structure 108 is mounted in the first handle half 22 with the pivoting arms 122 positioned within the retaining flanges to thereby retain the pivoting structure 108 in a fixed longitudinal position relative to the first handle half 22. A pair of threaded protrusions are provided adjacent the retaining flanges. A cover member 126 is secured to the threaded protrusions by fasteners thereby securing the pivoting structure 108 within the first handle half 22.

Sufficient space is provided between the cover member 126 and the pivoting structure 108 such that the pivoting structure 108 may pivot in a "see-saw" manner about the rounded protuberances 124 provided on the pivoting arms 122. Thus, when one end wall 112 or 114 moves upwardly, the opposite end wall 114 or 112 moves downwardly.

The rearwardly extending actuating slide 78 provided on the blade carrier 14 includes a longitudinally extending slot 128. Further, the actuating slide 78 is bent such that a distal end of the slide 78 extends in a different plane than a proximal end of the slide 78 adjacent the web portion 70. Thus, the slide 78 includes a first portion 130 in a first plane, a second portion 132 in a second plane, and a ramped portion 134 that interconnects the first and second portions 130, 132.

Figure 11:
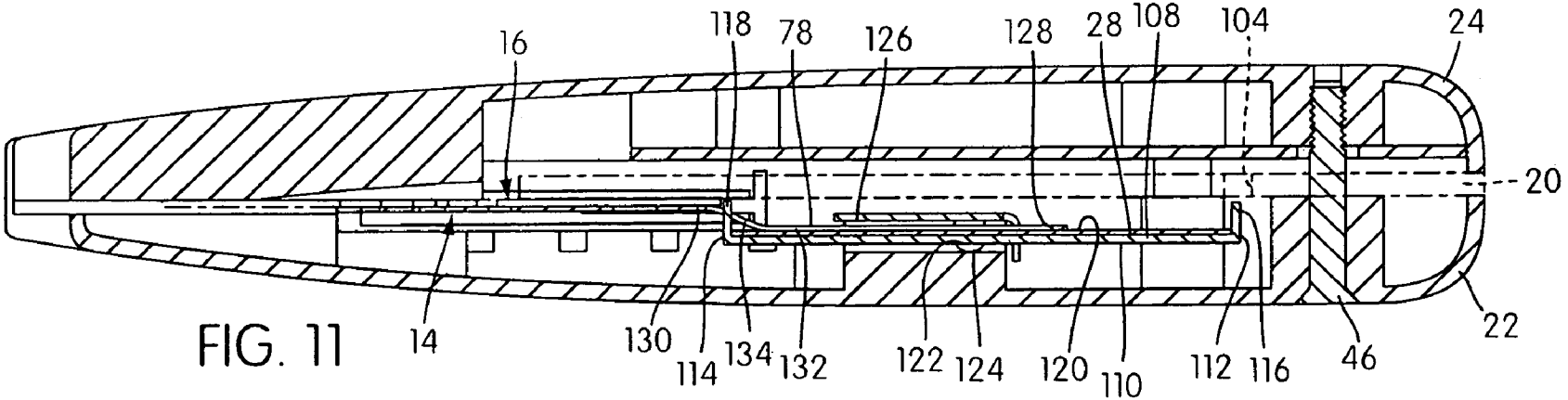
FIG. 11 is a cross-section taken along line 11-11 of FIG. 10.

The pivoting structure 108 is oriented such that the T-shaped extension 118 of the pivoting structure 108 is slidably mounted within the slot 128 in the actuating slide 78. The distal end of the slide 78 extends between the cover member 126 and the pivoting structure 108. As shown in FIGS. 10 and 11, when the utility blade 16 is in the storage position, the slide 78 maintains the T-shaped extension 118 at a position in the first portion 130 thereof. At this position, the T-shaped extension 118 and the elongated extension 116 are generally equally upwardly spaced from an interior surface of the first handle half 22.

Figure 13:
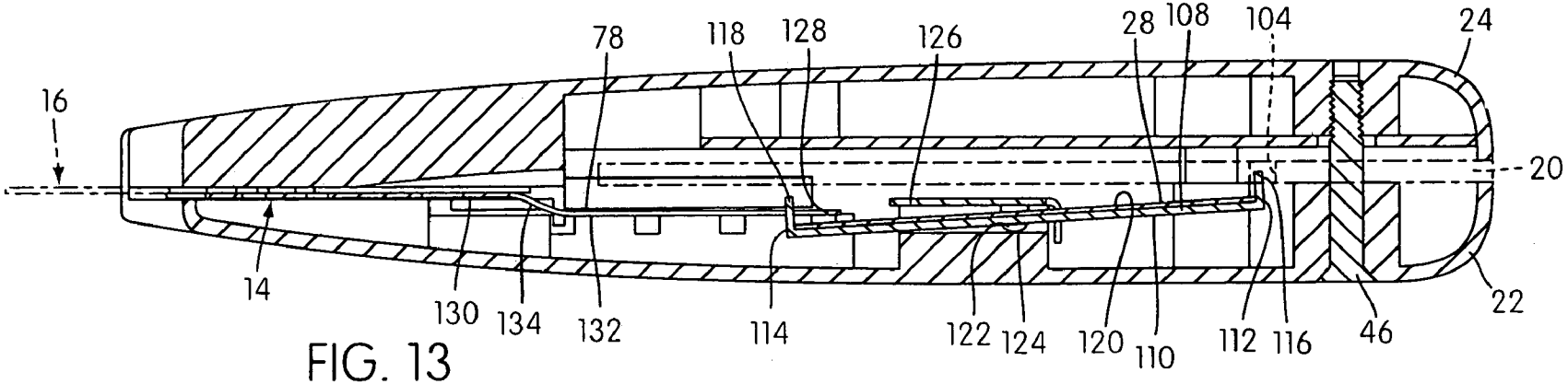
FIG. 13 is a cross-section taken along line 13-13 of FIG. 12.

As shown in FIGS. 12 and 13, as the utility blade 16 is moved in the longitudinal direction from the storage position to an operative position (with the movable blade 20 in the storage position), the slide 78 moves relative to the T-shaped extension 118. Due to the shape of the slide 78, continued movement of the blade carrier 14 and the utility blade 16 thereof causes the T-shaped extension 118 to ride downwardly along the ramped portion 134 and continue along the second portion 132 of the slide 78 in the second plane. This tends to cam the opposite end wall 112 with the elongated extension 116 upwardly and the elongated extension 116 moves into the hole 104 in the movable blade 20. As a result, the movable blade 20 cannot be pivoted out of handle 12. Thus, the pivoting structure 108 prevents the movable blade 20 from being pivoted out of the handle 12 when the utility blade 16 is moved to an operative position. The utility blade 16 must be moved to the storage position in order to cam the end wall 112 of the pivoting structure 108 downwardly. This will remove the elongated extension 116 from the hole 104 in the movable blade 20 to thereby permit pivotal movement of the movable blade 20.

Figure 15:
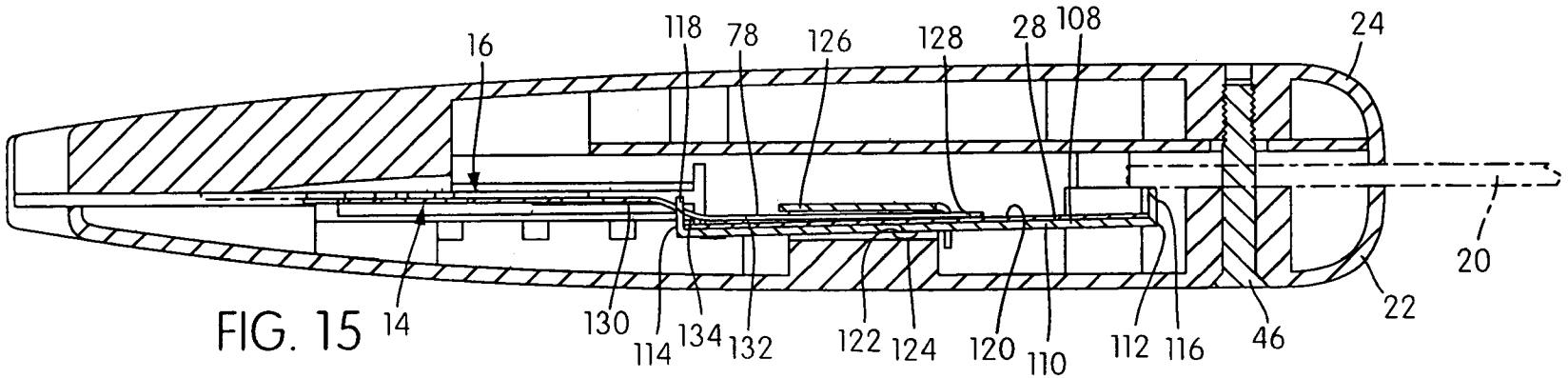
FIG. 15 is a cross-section taken along line 15-15 of FIG. 14.

Alternatively, as shown in FIGS. 14 and 15, when the movable blade 20 is in the operative position (with the utility blade 16 in the storage position), as the utility blade 16 is moved in the longitudinal direction to an operative position, the slide 78 causes the T-shaped extension 118 to ride slightly downwardly along the ramped portion 134, which tends to cam the end wall 112 with the elongated extension 116 upwardly. As the elongated extension 116 moves upwardly, it engages an outer surface of the movable blade 20. As a result, the T-shaped extension 118 at the opposite end wall 114 is prevented from moving downwardly and cannot continue moving down the ramped portion 134 to the second portion 132. Thus, the blade carrier 14 and the utility blade 16 thereof is prevented from further movement in the longitudinal direction and the hence into an operative position. The movable blade 20 must be moved to the storage position in order to permit the pivoting structure 108 to cam further upwardly with the elongated extension 116 moving into the hole 104 in the movable blade 20, thereby permitting the blade carrier 14 and the utility blade 16 thereof to move in the longitudinal direction.

Thus, the blade interlocking mechanism 28 locks the movable blade 20 in the storage position when the blade carrier 14 and utility blade 16 thereof are moved to an operative position. Likewise, the blade interlocking mechanism 28 locks the blade carrier 14 and utility blade 16 thereof in the storage position when the movable blade 20 is moved to an operative position.

Although the above-described blade interlocking mechanism 28 is preferred, it is contemplated that other mechanisms may be used so that only one of the utility blade 16 and the movable blade 20 may be moved to the operative position at a time.

Figure 16:
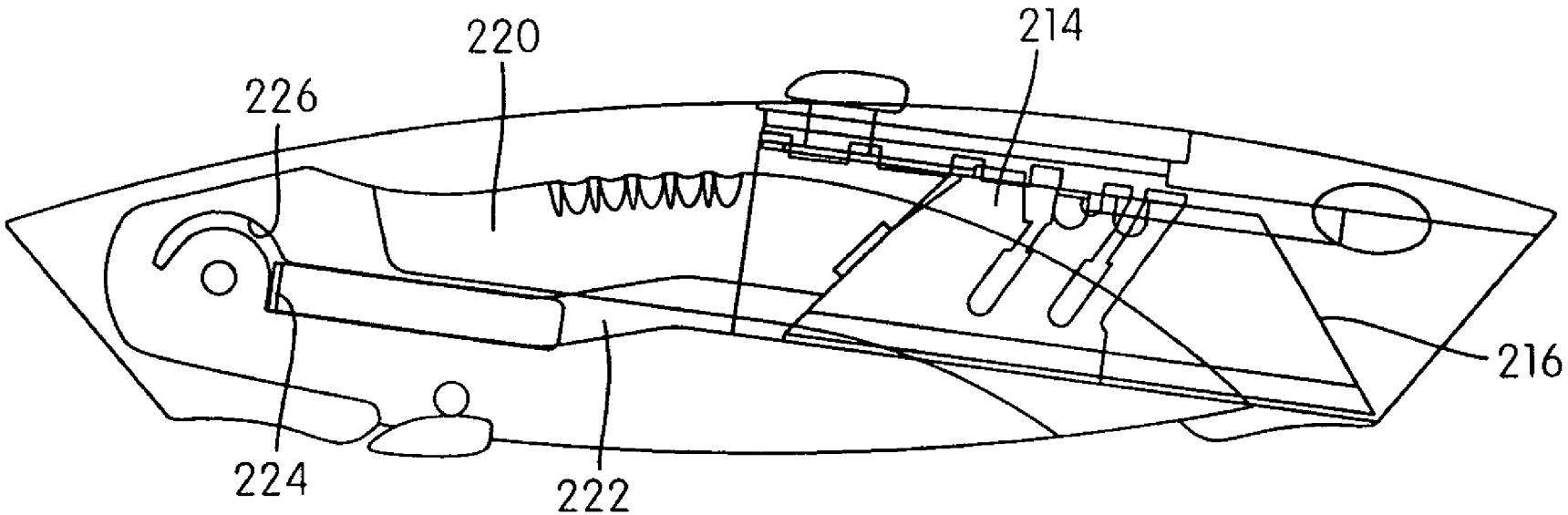
FIG. 16 is a side view of the combination utility and sporting knife illustrating another embodiment of the blade interlocking mechanism, the pivotally movable blade and the utility blade in the storage position.
Figure 17:
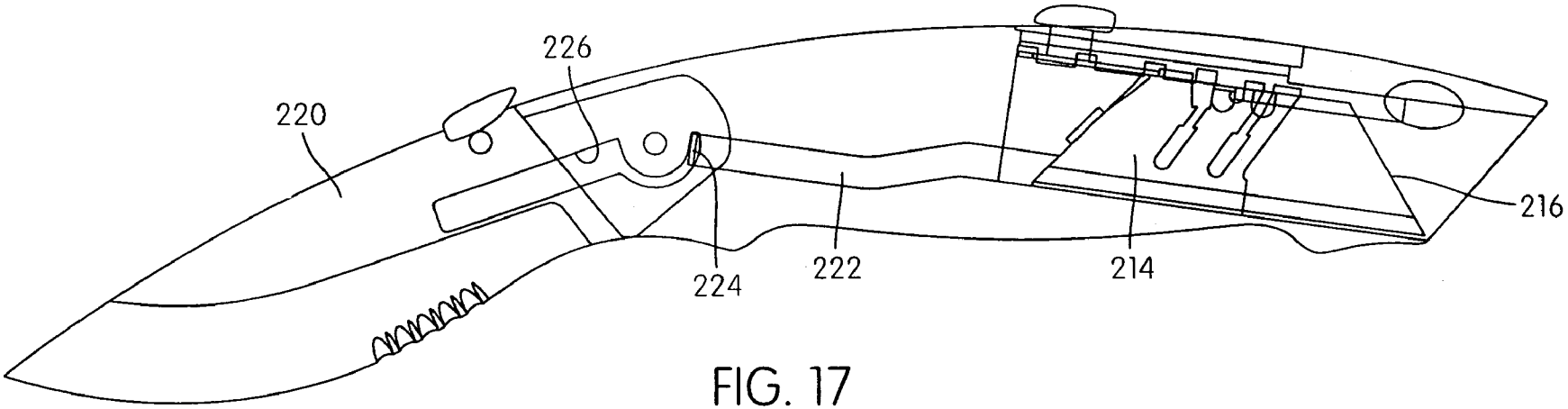
FIG. 17 is a side view of the combination utility and sporting knife shown in FIG. 16 with the pivotally movable blade in the operative position and the utility blade in the storage position.
Figure 18:
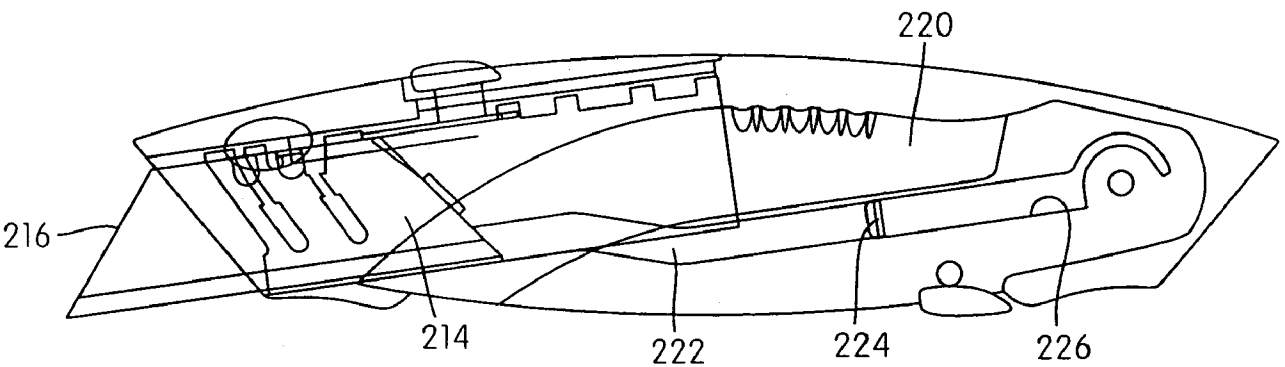
FIG. 18 is a side view of the combination utility and sporting knife shown in FIG. 16 with the pivotally movable blade in the storage position and the utility blade in the operative position.

For example, FIGS. 16-18 illustrate a mechanism wherein a blade carrier 214 has an extension 222 with a flanged end 224 that is received within a slot 226 provided in a movable blade 220. When the movable blade 220 is pivoted to the operative position (as shown in FIG. 17), the end 224 of the extension 222 rides along an arcuate portion of the slot 226. The path of the slot 226 is configured such that, when the movable blade 220 is in the operative position, the blade carrier 214 and the utility blade 216 thereof cannot move longitudinally from the storage position to an operative position. Likewise, when the blade carrier 214 and utility blade 216 thereof is moved to an operative position (as shown in FIG. 18), the end 224 of the extension 222 rides along an elongated portion of the slot 226. Hence, the movable blade 220 cannot be pivotally moved from the storage position to an operative position.

Referring now more particularly to FIGS. 5-7, the movable blade locking mechanism 26 functions to lock the movable blade 20 in the storage and operative positions. The locking mechanism 26 includes a flat spring 136 secured to the second handle half 24. The flat spring 136 has a locking arm 138 that is biased outwardly from the second handle half 24. The locking arm 138 has a locking tab 140 at the distal end thereof. The locking arm 138 also includes a series of serrations 142 that are accessible through the handle 12.

As shown in FIGS. 5 and 6, when the movable blade 20 is in the storage position, the locking arm 138 is biased into engagement with the moveable blade 20 such that the locking tab 140 is received within the slot 106 provided in the movable blade 20. This locks the movable blade 20 in the storage position and prevents pivotable movement of the movable blade 20 relative to the handle 12. In order to pivot the movable blade 20 out of the handle 12, the locking arm 138 must be pivoted away from the movable blade 20 to remove the locking tab 140 from the slot 106.

Once the movable blade 20 is moved out of the storage position and towards the operative position, the locking arm 138 may be released which causes the locking tab 140 to engage the exterior surface of the movable blade 20 due to the biasing of the locking arm 138. As the movable blade 20 is pivoted towards the operative position, the locking tab 140 rides along the exterior surface of the movable blade 20. As shown in FIG. 7, when the movable blade 20 reaches the operative position, the locking tab 140 drops to a position adjacent the side edge of the movable blade 20. This locks the movable blade 20 in the operative position. In order to pivot the movable blade 20 into the storage position, the locking arm 138 must be pivoted away from the movable blade 20 to move the locking tab 140 to a position outwardly from the movable blade 20. Thus, the movable blade 20 may be retracted back into the housing 12 into the storage position.

Figure 2:
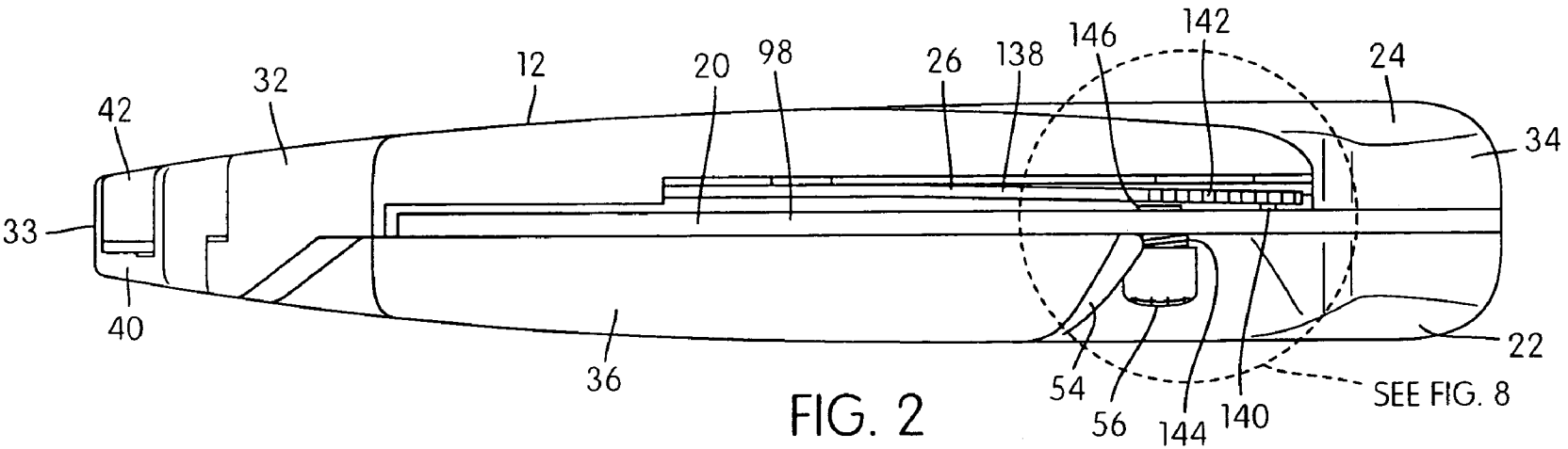
FIG. 2 is a bottom view of the combination utility and sporting knife shown in FIG. 1.
Figure 9:
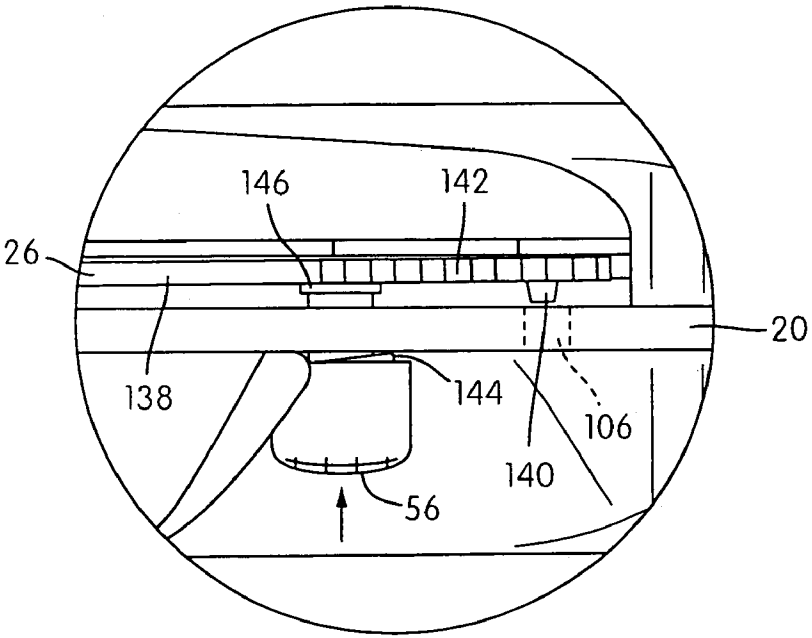
FIG. 9 is an enlarged bottom view of the combination utility and sporting knife shown in FIG. 1 illustrating a depressed thumb button which unlocks the pivotally movable blade.
Figure 8:
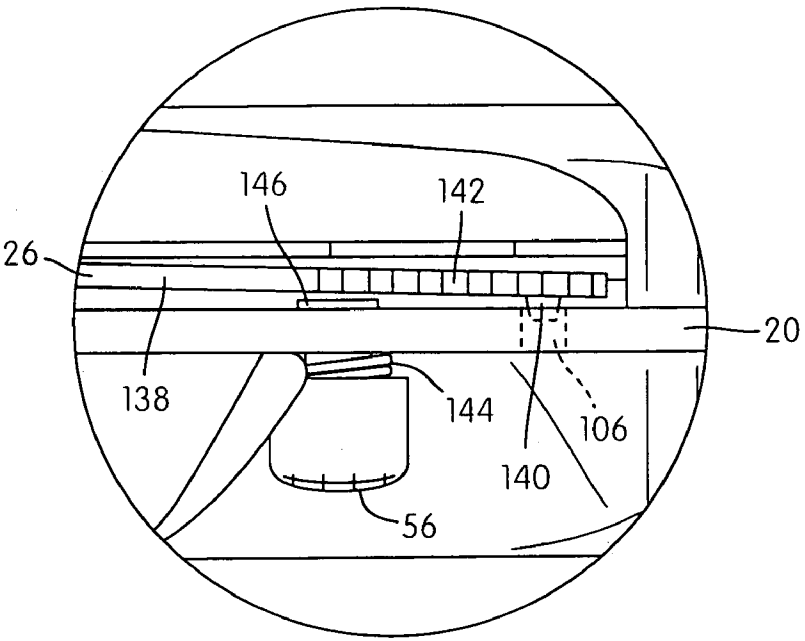
FIG. 8 is an enlarged bottom view of the combination utility and sporting knife shown in FIG. 1 illustrating the thumb button.

Referring now more particularly to FIGS. 2, 8, and 9, the movable blade 20 includes the thumb button 56. A biasing member 144, such as a spring, biases the thumb button 56 outwardly from the movable blade 20. The thumb button 56 is biased such that, when the movable blade 20 is in the storage position (as shown in FIGS. 2 and 8), the one end 146 of the thumb button 56 adjacent the locking arm 138 is positioned to allow the locking tab 140 of the locking arm 138 to be received within the slot 106 of the movable blade 20. When the thumb button 56 is depressed against the bias of the biasing member 44 (as shown in FIG. 9), the one end 146 engages the locking arm 138 and pivots the locking tab 140 out of the slot 106 to unlock the movable blade 20 and permit pivotable movement of the movable blade 20 out of the handle 12. The thumb button 56 is positioned to enable the user to pivot the movable blade 20 out of the handle 12 with his/her thumb.

Although the above-described movable blade locking mechanism 26 is preferred, it is contemplated that other mechanisms may be used to lock the movable blade 20 in the storage and operative positions.

Figure 3:
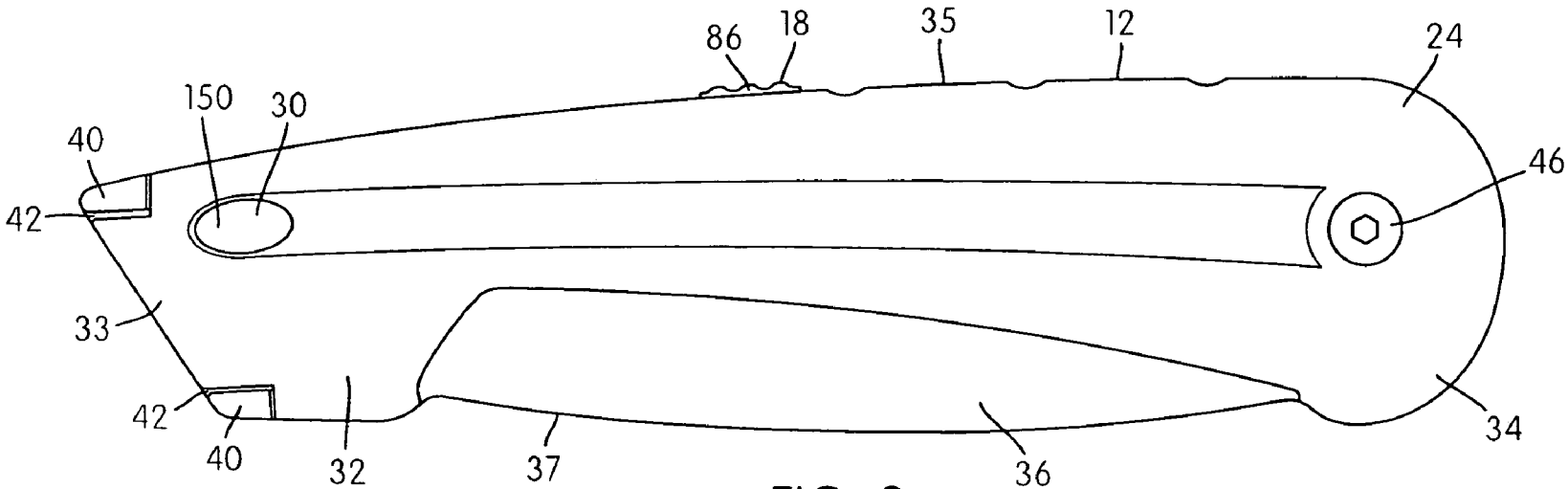
FIG. 3 is a side view of the combination utility and sporting knife shown in FIG. 1.

The utility blade replacement mechanism 30 enables a user to remove and replace utility blades 16 from the blade carrier 14 without uncoupling the handle halves 22, 24. As shown in FIGS. 3 and 4, the replacement mechanism 30 includes an elongated arm 148 having one end secured within the utility blade retaining portion 32 of the second handle half 24 and the opposite free end having a knob 150 that extends through an opening in the second handle half 24. When the blade carrier 14 and the utility blade thereof is the fully extended operative position, the knob 150 may be pressed by the user to pivot the opposite end of the arm 148 into one of the upper blade retaining flanges 72 of the blade carrier 14. This moves the blade retaining flange 72 as well the blade engaging protrusion 60 in a direction away from the utility blade 16. As a result, the blade engaging protrusion 60 is not located within the second notch 58*b* in the utility blade 16, and the utility blade 16 may be removed from the blade carrier 14. Further details of the replacement mechanism 30 are provided in U.S. Pat. No. 6,192,589, the entirety of which is hereby incorporated by reference.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed is:

1. A combination utility and sporting knife, comprising:

a longitudinal knife handle;

a utility blade movably carried by said handle, said utility blade having a linear cutting edge and being movable between 1) a storage position wherein said cutting edge thereof is confined within said handle, and 2) an operative position wherein said cutting edge thereof is exposed;

a pivotally movable sporting blade pivotally movable with respect to said handle, said pivotally movable sporting blade comprising a cutting edge and an opposite dull edge, said cutting edge having a convex forward portion, said convex forward portion of said cutting edge intersecting with said dull edge to form a forward point of said pivotally movable sporting blade, said pivotally movable sporting blade being movable between a storage position wherein said cutting edge thereof is concealed by said handle and an operative position wherein said cutting edge thereof is exposed; and a blade interlock constructed to prevent movement of one of the utility blade and the pivotally movable sporting blade from the storage position thereof when the other of the utility blade and the pivotally movable sporting blade is in the operative position thereof.

2. The combination according to claim 1, wherein the utility blade has a trapezoidal shape, a longest side of which comprises the linear cutting edge.

3. The combination according to claim 1, wherein the utility blade is releasably carried by the handle.

4. The combination according to claim 1, wherein the utility blade is slidable with respect to the handle.

5. A combination utility and sporting knife, comprising:

a knife handle;

a utility blade carrier movably mounted with respect to said handle;

a utility blade releasably carried by said blade carrier, said blade carrier being movable between 1) a first position wherein said utility blade carried thereby is positioned so that said utility blade is in a storage position wherein said cutting edge thereof is concealed by said handle, and 2) a second position wherein said utility blade carried thereby is positioned so that said utility blade is in an operative position wherein said cutting edge thereof is exposed;

a pivotally movable sporting blade pivotally movable with respect to said handle, said pivotally movable sporting blade comprising a cutting edge and an opposite dull edge, said cutting edge having a convex forward portion, said convex forward portion of said cutting edge intersecting with said dull edge to form a forward point of said pivotally movable sporting blade, said pivotally movable sporting blade being movable between a storage position wherein said cutting edge thereof is concealed by said handle and an operative position wherein said cutting edge is exposed; and a blade interlock constructed to prevent movement of one of the utility blade and the pivotally movable sporting blade from the storage position thereof when the other of the utility blade and the pivotally movable sporting blade is in the operative position thereof.

6. The combination according to claim 5, wherein utility blade carrier is linearly movable within said handle.

7. The combination according to claim 5, wherein said utility blade has a trapezoidal shape, a longest side of which comprises a linear cutting edge.

8. The combination according to claim 6, further comprising a manually movable blade moving member operatively connected with said blade carrier.

9. The combination according to claim 8, wherein said utility blade and said pivotally movable sporting blade are extendable from opposite ends of said handle.

10. The combination according to claim 9, wherein the utility blade carrier, the utility blade, and the manually movable blade moving member constitute a utility blade assembly, and wherein the blade interlock is constructed to interact with the utility blade assembly and pivotally movable sporting blade to prevent movement of one of the utility blade and the pivotally movable sporting blade from the storage position thereof when the other of the utility blade and the pivotally movable sporting blade is in the operative position thereof.

11. The combination according to claim 10, wherein the utility blade is releasably carried by the blade carrier.

12. The combination according to claim 5, wherein the blade interlock includes an elongated pivoting structure that interacts with a rearwardly extending actuating slide provided on the blade carrier, the actuating slide of the blade carrier being configured and positioned such that (a) when the pivotally movable sporting blade is in the storage position, movement of the utility blade from a storage position to an operative position pivotally moves one end of the pivoting structure into a hole provided in the pivotally movable sporting blade to thereby prevent movement of the pivotally movable sporting blade from the storage position thereof and (b) when the pivotally movable sporting blade is in the operative position, movement of the utility blade from a storage position to an operative position is prevented due to engagement of one end of the pivoting structure with an outer surface of the pivotally movable sporting blade.

* * * * *